US007980482B2

(12) United States Patent
Lou et al.

(10) Patent No.: US 7,980,482 B2
(45) Date of Patent: Jul. 19, 2011

(54) THERMOSTATIC EXPANSION VALVE HAVING A RESTRICTED FLOW PASSAGE FOR NOISE ATTENUATION

(75) Inventors: Zheng Lou, Plymouth, MI (US); Thomas Joseph, Sr., Commerce, MI (US)

(73) Assignee: Automotive Components Holdings, LLC, Dearborn, MI (US)

( * ) Notice: Subject to any disclaimer, the term of this patent is extended or adjusted under 35 U.S.C. 154(b) by 786 days.

(21) Appl. No.: 11/893,691

(22) Filed: Aug. 17, 2007

(65) Prior Publication Data

US 2009/0045264 A1 Feb. 19, 2009

(51) Int. Cl.
*F25B 41/04* (2006.01)
*F25B 41/06* (2006.01)
*G05D 23/12* (2006.01)

(52) U.S. Cl. ..... 236/92 B; 236/92 R; 236/93 A; 236/93 R; 236/99 J; 236/100

(58) Field of Classification Search ..... 236/92 B, 236/92 R, 93 A, 93 R, 100, 99 J
See application file for complete search history.

(56) References Cited

U.S. PATENT DOCUMENTS 5,251,459 A * 10/1993 Grass et al. ..... 62/324.1
5,961,038 A * 10/1999 Okada ..... 236/92 B
6,189,800 B1 * 2/2001 Fujimoto et al. ..... 236/92 B
6,658,877 B2 * 12/2003 Kjøng-Rasmussen ..... 62/222
2004/0007015 A1 1/2004 Sendo et al.
2007/0194140 A1 * 8/2007 Nestler et al. ..... 236/92 B

FOREIGN PATENT DOCUMENTS

JP 2003-322435 11/2003

* cited by examiner

*Primary Examiner* — Cheryl J Tyler
*Assistant Examiner* — Paolo Gonzalez
(74) *Attorney, Agent, or Firm* — MacMillan, Sobanski & Todd, LLC

(57) ABSTRACT

A thermostatic expansion valve includes a valve body having an evaporator inlet port, an evaporator outlet port, a suction line port, and a liquid line port. A sensor chamber formed within the valve body is disposed between the evaporator outlet port and the suction line port. A valve is disposed within the valve body controls a flow of refrigerant from the liquid line port to the evaporator inlet port. A diaphragm separates a charge chamber and a pressure chamber where a pressure differential between a charge chamber and a pressure chamber controls the positioning of the valve. A restriction flow passage located to provide fluid communication between the sensor chamber and the pressure chamber is configured to limit a flow rate from the pressure chamber to sensor chamber, thereby slowing the opening of the valve resulting in a reduction of noise generated following an initial startup of a compressor.

18 Claims, 9 Drawing Sheets

THERMOSTATIC EXPANSION VALVE HAVING A RESTRICTED FLOW PASSAGE FOR NOISE ATTENUATION

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

1. Field of Invention

This invention relates in general to air conditioning systems, and in particular to a thermostatic expansion valve.

2. Background of Related Art

A thermostatic expansion valve controls the flow of refrigerant through a closed loop refrigerant system. The thermostatic expansion valve senses the temperature and pressure of the refrigerant at the outlet of an evaporator and adjusts the opening and closing of a valve element within the thermostatic expansion valve to control the amount of refrigerant to the evaporator, and thus the superheat at the outlet of the evaporator.

The closed loop refrigeration system includes fluid conduits, a condenser, an evaporator, a compressor, and a thermostatic expansion valve. The thermostatic expansion valve includes a liquid line port (commonly known as Port A), an evaporator inlet port (commonly known as Port B), an evaporator outlet port (commonly known as Port C) and a suction line port (commonly known as Port D). The compressor compresses fluid refrigerant fluid within the closed loop system. The refrigerant then flows through the condenser. The condenser cools the refrigerant. The thermostatic expansion valve senses the temperature and pressure of the refrigerant exiting the evaporator and actuates a valve member within the thermostatic expansion valve for controlling the amount of refrigerant flowing from the condenser to the evaporator and thus achieving a desired superheat at the evaporator outlet. The refrigerant flows through the valve and into the evaporator where blown air is passed through the evaporator. The refrigerant absorbs heat from the air as it flow through the evaporator. The cooled air is used to cool the interior of a vehicle or a room.

A diaphragm within the thermostatic expansion valve separates two chambers (i.e., a charge chamber and a pressure chamber). The pressure differential on two sides of the diaphragm controls the opening and closing of the valve. When the pressure in the charge chamber is greater than the pressure in the pressure chamber, there is a net force on the diaphragm from the charge chamber to the pressure chamber, displacing fluid in the pressure chamber. In prior art designs, the pressure chamber is either in substantial fluid communication with a sensor chamber through a relatively wide open flow passage, or a structural extension of a sensor chamber that is situated between the evaporator outlet port and the suction line port.

Therefore, in prior art designs, the pressure chamber pressure substantially follows the suction pressure at the sensor chamber.

During an initial period following a compressor startup, charge chamber temperature does not rapidly follow the evaporator outlet temperature, and as a result, the charge chamber pressure is relatively steady (i.e., drops slowly). On the other hand, the pressure chamber pressure drops rapidly with the suction pressure at a compressor startup. Since it takes longer for the charge chamber temperature to substantially reach its steady state than for the pressure chamber to substantially reach its steady state at the compressor startup, the thermostatic expansion valve opens rapidly and substantially, which also happens before the liquid line refrigerant is substantially sub-cooled. The diaphragm pushes a rapid rising valve open.

BRIEF SUMMARY OF THE INVENTION

The present invention has the advantage of delaying the opening of the thermostatic expansion valve so to reduce to noise generated during an initial period following a compressor startup. The gradual opening of the valve allows more time for the high pressure side of the refrigerant loop to be pressurized thereby reaching a more sub-cooled state, absorbing residual vapor, and reducing the initial refrigerant flow rate. As a result, the hissing noise through the thermostatic expansion valve shortly after compressor startup is minimized.

In one aspect of the present invention, a thermostatic expansion valve is provided for a vehicle air conditioning system. The thermostatic expansion valve includes a valve body having an evaporator inlet port and an evaporator outlet port. The valve body further includes a suction line port and a liquid line port. A sensor chamber is formed within the valve body and disposed between the evaporator outlet port and the suction line port. A valve is disposed within the valve body for controlling a flow of refrigerant from the liquid line port to the evaporator inlet port. A diaphragm separates a charge chamber and a pressure chamber where a pressure differential between a charge chamber and a pressure chamber controls the positioning of the valve. A restriction flow passage located to provide fluid communication between the sensor chamber and the pressure chamber and configured to limit a flow rate from the pressure chamber to sensor chamber, thereby slowing the opening of the valve resulting in a reduction of noise generated following an initial startup of a compressor.

In yet another aspect of the present invention, a thermostatic expansion valve for a vehicle air conditioning system includes a valve body having an evaporator inlet port and an evaporator outlet port. The valve body further includes a suction line port and a liquid line port. A sensor chamber is formed within the valve body and is disposed between the evaporator outlet port and the suction line port. A valve is disposed within the valve body for controlling a flow of refrigerant from the liquid line port to the evaporator inlet port. A diaphragm separates a charge chamber and a pressure chamber where a pressure differential between the charge chamber and the pressure chamber operatively controls the positioning of the valve. A restriction flow passage is located to provide fluid communication between the sensor chamber and the pressure chamber and is configured to limit a flow rate from the pressure chamber to sensor chamber thereby slowing the opening of the valve resulting in a reduction of noise generated following a startup of a compressor. The restriction flow passage includes a first annular passage of a first diameter in fluid communication with a second annular passage of a second diameter. The second diameter being smaller than the first diameter restricts the flow of fluid between the pressure chamber and the sensor chamber.

In yet another aspect of the present invention, a thermostatic expansion valve is provided for a vehicle air conditioning system includes a valve body having an evaporator inlet port and an evaporator outlet port. The valve body further includes a suction line port and a liquid line port. A sensor chamber is formed within the valve body and disposed between the evaporator outlet port and the suction line port. A valve is disposed within the valve body. The valve controls a flow of refrigerant from the liquid line port to the evaporator inlet port. A diaphragm separates a charge chamber and a pressure chamber where a pressure differential between a charge chamber and a pressure chamber controls the positioning of the valve. A check valve that includes a check valve ball is disposed between the sensor chamber and the pressure chamber allows fluid flow from the sensor chamber to the pressure chamber when the pressure difference between the sensor chamber and pressure chamber is above a predetermined pressure differential. A restriction flow passage located to provide fluid communication between the sensor chamber and the pressure chamber and configured to limit a flow rate from the pressure chamber to sensor chamber, thereby slowing the opening of the valve resulting in a reduction of noise generated shortly after compressor startup. The restriction flow passage is formed by a leakage flow path around the check valve ball when the check valve is in a seated position.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
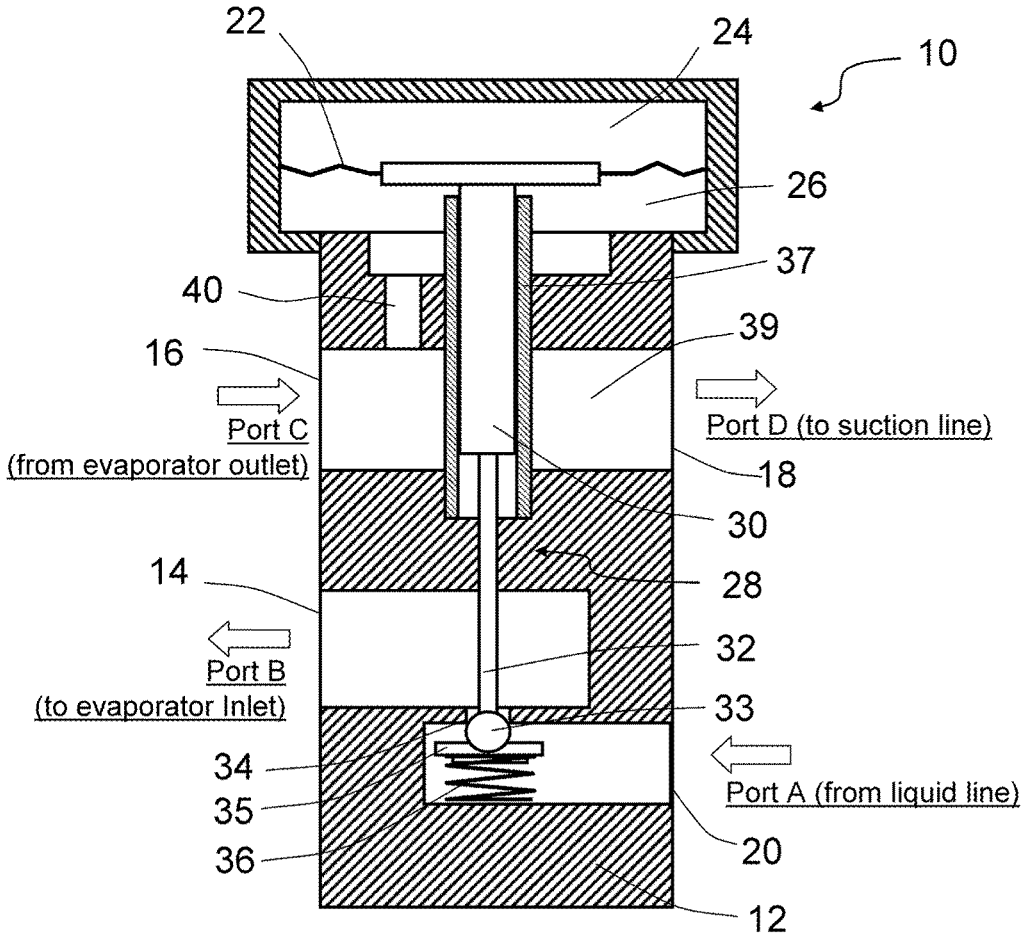
FIG. 1 Prior Art
FIG. 1 illustrates a thermostatic expansion valve of a prior art system.

Referring now to the drawings, there is illustrated in FIG. 1 a conventional thermostatic expansion valve generally shown at 10. The valve 10 includes a valve body 12. The valve body 12 includes an evaporator inlet port 14 (commonly known as Port B) and an evaporator outlet port 16 (commonly known as Port C) in fluid communication with an evaporator (not shown). The valve body 12 further includes a suction line port 18 (commonly known as a Port D) and a liquid line port 20 (commonly known as a Port A) which are in fluid communication with a suction line (not shown) and a liquid line (not shown), respectively. A liquid line (not shown) is typically connected to a condenser outlet via a receiver (not shown) while a suction line is connected with a compressor inlet (not shown).

A diaphragm 22 disposed within a cavity in a power assembly (or charge assembly), which is generally assembled on the valve body 12, separates and operably maintains a charge chamber 24 and a pressure chamber 26. A valve assembly 28 is coupled to and moveable by the diaphragm 22. Movement of the valve assembly 28 selectively allows for fluid flow between the liquid line port 20 and the evaporator inlet port 14. The valve assembly 28 includes a temperature sensor 30 that is coupled to a rod 32 at a first end. An opposing end of the rod 32 is coupled to a valve member 33. The valve member 33 is seated in a valve seat 34. A carrier 35 is disposed on the opposing side of the valve member 33 from the valve seat 34. A spring 36 is disposed between the carrier 35, which is in contact with the valve member 33, and a portion of the valve body 12 for exerting a resistive force on the valve member 33 to urge valve member 33 toward a closed position. Alternatively, an adjusting nut (not shown) may be disposed in the valve body 12 in contact with an opposing end of the spring 36 for adjusting the compression force of the spring 36.

A sleeve 37 is disposed around the temperature sensor 30 for guiding the valve assembly 28 in a vertical direction as the valve member 33 is opened and closed.

A sensor chamber 39 is disposed within the thermostatic expansion valve 10 between the evaporator outlet port 16 and the suction line port 18. A flow passage 40, having an unrestricted opening, is provided between the pressure chamber 26 and the sensor chamber 39. The distinction between the pressure chamber 26 and the sensor chamber 39 is not obvious in many design variations of the prior art. In some valve designs (not shown), there is no clear structural separation between the two. Also, the fluid in and the structure around the pressure chamber contributes to the temperature sensing function as well through conduction and convection. The flow passage 40 equalizes the pressure in the pressure chamber 26 and the sensor chamber 39 and also allows for fluid flow between the pressure chamber 26 and the sensor chamber 39. Accordingly, when a pressure in the charge chamber 24 is greater than the pressure in the pressure chamber 26 sufficient to overcome the bias of the spring 36, the diaphragm 22 pushes the temperature sensor 30 down, which, in turn, forces fluid out of the pressure chamber 26 of the flow passage 40.

The following embodiments of the present invention employ many similar components. The same reference numbers will be utilized in the following figures to reference the same elements.

Figure 2:
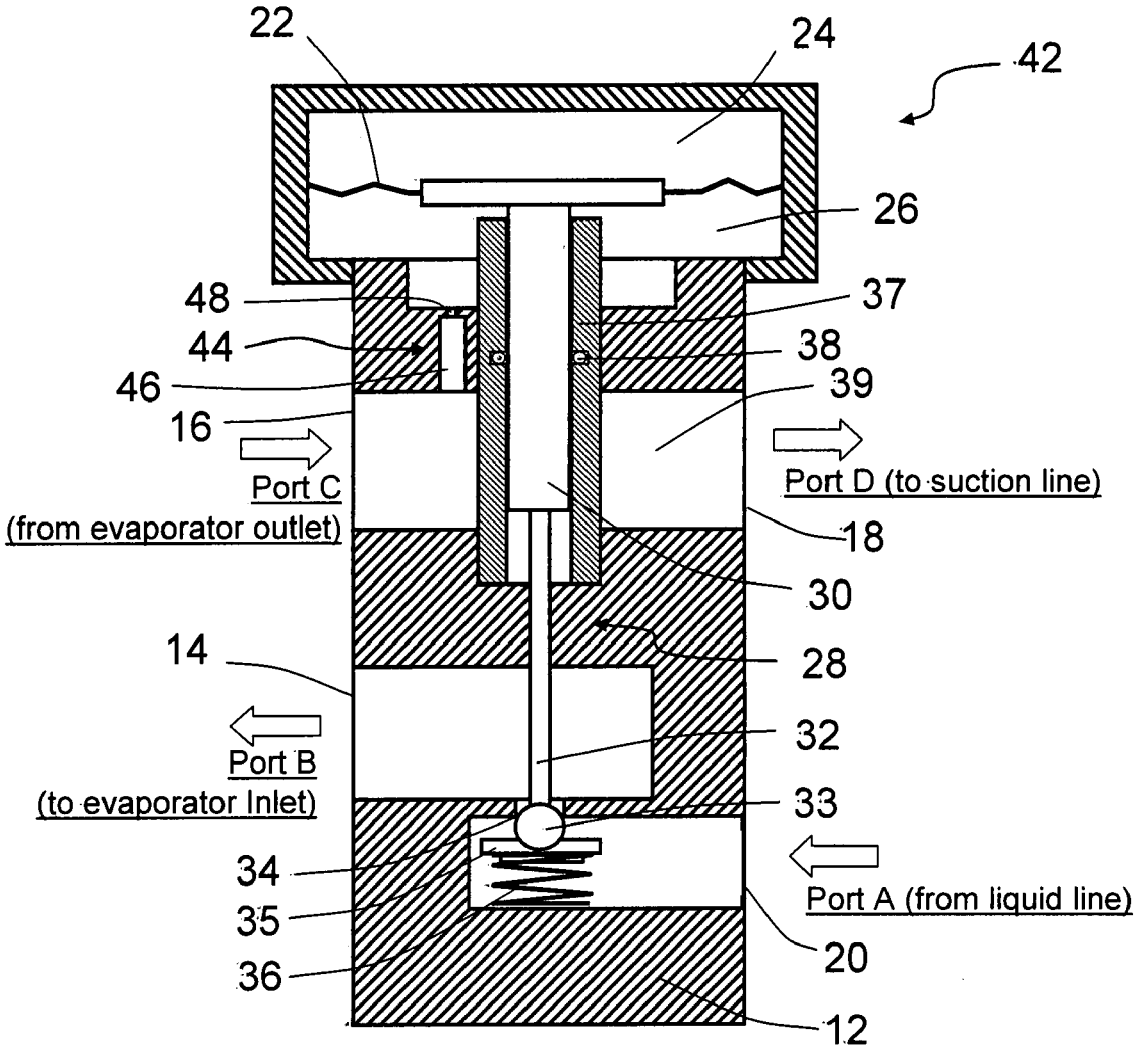
FIG. 2 illustrates a thermostatic expansion valve according to a first preferred embodiment of the present invention.

FIG. 2 illustrates a thermostatic expansion valve 42 according to a first preferred embodiment of the present invention. A restriction flow passage, generally shown at 44, is disposed between the pressure chamber 26 and the sensor chamber 39 for transferring refrigerant between the pressure chamber 26 and the sensor chamber 39. A first section 46 of the flow passage 44 is similar in diameter to the flow passage shown in FIG. 1. A second section 48 of the flow passage 40 is in fluid communication with the first section 46. Preferably, the sections of the restriction flow passage 44 are annular. Alternatively, the restriction flow passage may be any shape. The second section 48 has a smaller diameter orifice in comparison to the first section 46. The second section 48 is disposed between the pressure chamber 26 and the first section 46.

Another possible variation is not to include the first section 46 at all if the wall between the two chambers 26 and 39 is substantially thin around the passage 44, whose restriction is primarily offered by the second section 48, a shorter length orifice with a substantially small cross-sectional opening (e.g., 0.2 mm or less). Preferably the cross-sectional opening is annular; however, the cross-section opening may be any manufacturing-feasible shape will serve the purpose. Alternatively, the second section 48 may be disposed between the sensor chamber 39 and the first section 46.

The restriction of fluid flow, primarily as a result of the second section 48 reduces the rate of fluid that can flow through the flow passage 44 in contrast to the flow passage 40 shown in FIG. 1 or larger opening. The reduced rate of flow of fluid exiting the pressure chamber 26, in comparison to the flow passage 40 shown in FIG. 1, delays the opening of the valve member 33 and/or reduces the extent of the opening at compressor start-up. As a result, at compressor start-up the delayed and/or reduced opening of the valve member 33 allows more time for the high pressure side of the refrigerant loop to be pressurized, thereby reaching a more sub-cooled state, absorbing residual vapor, thus avoiding or reducing expansion of the refrigerant of high quality or vapor content. It also reduces the initial refrigerant flow rate. As a result, the hissing noise through the thermostatic expansion valve 42 shortly after compressor startup is minimized. Furthermore, the restriction of fluid communication between the pressure chamber 26 and the sensor chamber 39 reduces vibrations associated with the sudden opening of the valve member 33 that may occur during compressor startup. To reduce the impact of the leakage flow between the temperature sensor 30 and the sleeve 37, an O-ring 38 may be disposed within the sleeve 37 for maintaining a seal between the temperature sensor 30 and the sleeve 37 as the temperature sensor 30 sides within the bore of the sleeve 37.

Figure 3:
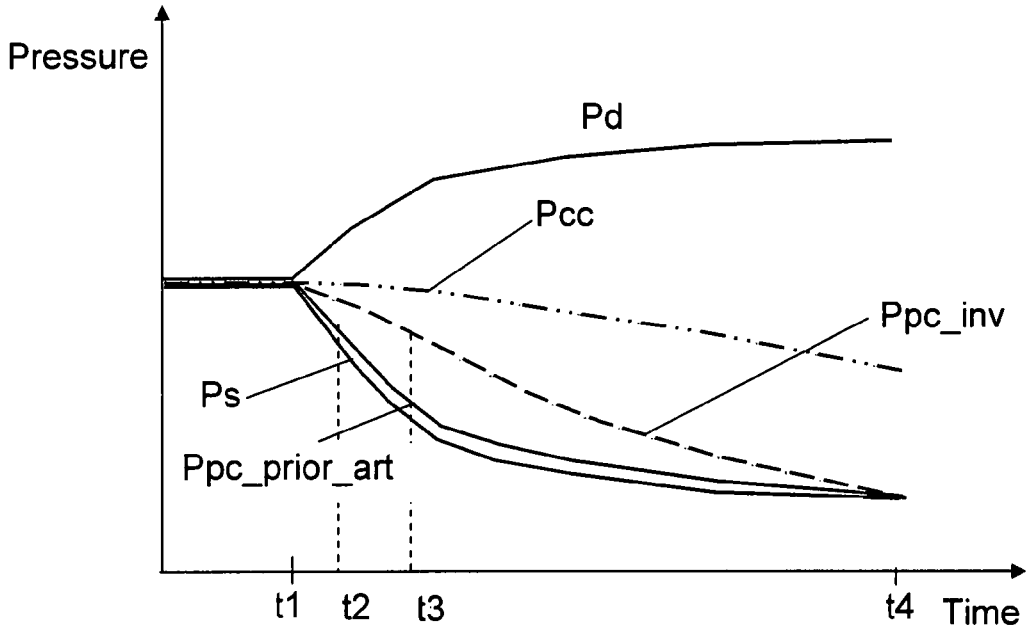
FIG. 3 illustrates a pressure vs time comparison chart.
Figure 4:
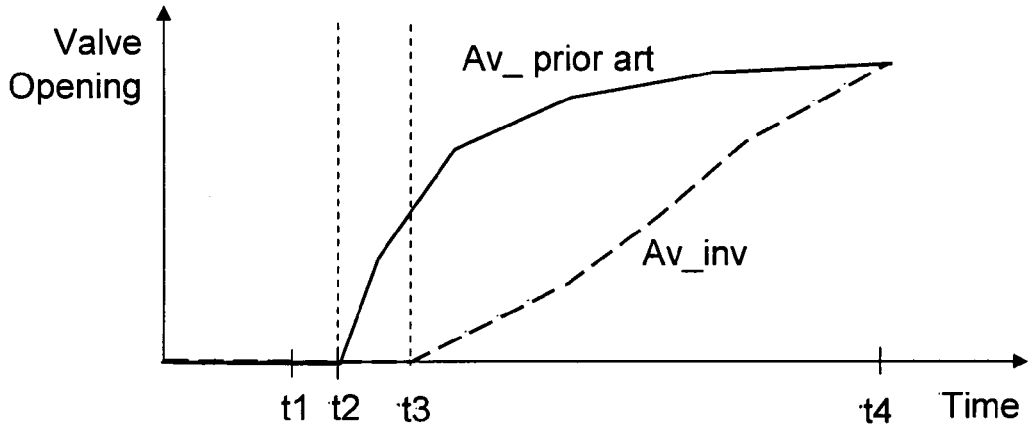
FIG. 4 illustrates a valve opening vs time comparison chart.

FIGS. 3 and 4 illustrate a pressure versus time comparison chart and a valve opening versus time comparison chart, respectively. In these charts, the compressor startup is at time $t_1$. Line $P_d$ represents a discharge pressure from the condenser. Line $P_s$ represents a suction pressure to and from the evaporator. $P_{cc}$ represents the pressure in the charge chamber 24 for both FIGS. 1 and 2. $P_{pc_prior_art}$ represents a pressure in the pressure chamber for the prior art thermostatic expansion valve (shown in FIG. 1). $P_{pc_inv}$ represents a pressure in the pressure chamber for the thermostatic expansion valve shown in FIG. 2. In FIG. 4, $Av_{prior_art}$ represents the valve opening of the prior art thermostatic expansion valve. $Av_{inv}$ represents the valve opening of the valve as shown in FIG. 2.

As shown in FIGS. 3 and 4, the system discharge $P_d$ and suction pressure $P_s$ are substantially equal at the saturation pressure of the initial system temperature ($T_o$) before compressor start-up. Once the compressor is turned on at time $t_1$, the discharge pressure $P_d$ and suction pressure $P_s$ start to grow apart from one another with the discharge pressure $P_d$ rising and the suction pressure $P_s$ falling. In relation to thermostatic expansion valve of FIG. 1, the flow port is relatively wide open and the pressure chamber pressure $P_{pc_prior_art}$ substantially follows the suction pressure $P_s$. Also, charge chamber temperature does not rapidly follow the evaporator outlet temperature, and therefore, the charge chamber pressure $P_{cc}$ drops slowly resulting in a rapidly rising differential pressure across the diaphragm thereby pushing a rapidly rising valve open $Av_{prior_art}$. The valve opens at time $t_2$ which is typically around 2 seconds after time $t_1$ when the charge chamber pressure $P_{cc}$ overcomes the spring's preload. The abrupt opening of the valve member during the start of the compressor when the refrigerant has a high vapor content (low subcool) results in the hissing noise.

As shown in FIGS. 3 and 4, the pressure drop in the pressure chamber $P_{pc_inv}$ of the present invention can be slowed by delaying the opening of the valve member. The pressure drop can be slowed by restricting the amount of fluid that initially flows from the pressure chamber to the sensor chamber. The restriction of flow is represented by the pressure chamber line $P_{pc_inv}$ over time. As shown in FIG. 3, the pressure in the pressure chamber $P_{pc_inv}$ of the present invention does not directly follow the suction pressure $P_s$ as does the pressure chamber $P_{pc_prior_art}$ of the prior art. As a result, the opening of the valve $Av_{inv}$ occurs at a time $t_3$ which is later than the opening time of $Av_{prior_art}$. In addition, the initial opening of the valve to the time when the valve reaches its fully opened position is less abrupt than that shown in the prior art $Av_{prior_art}$. As result, the delay and gradual opening of the valve member to its fully opened position during an initial startup of the compressor reduces the noise generated by thermostatic expansion valve.

Figure 5:
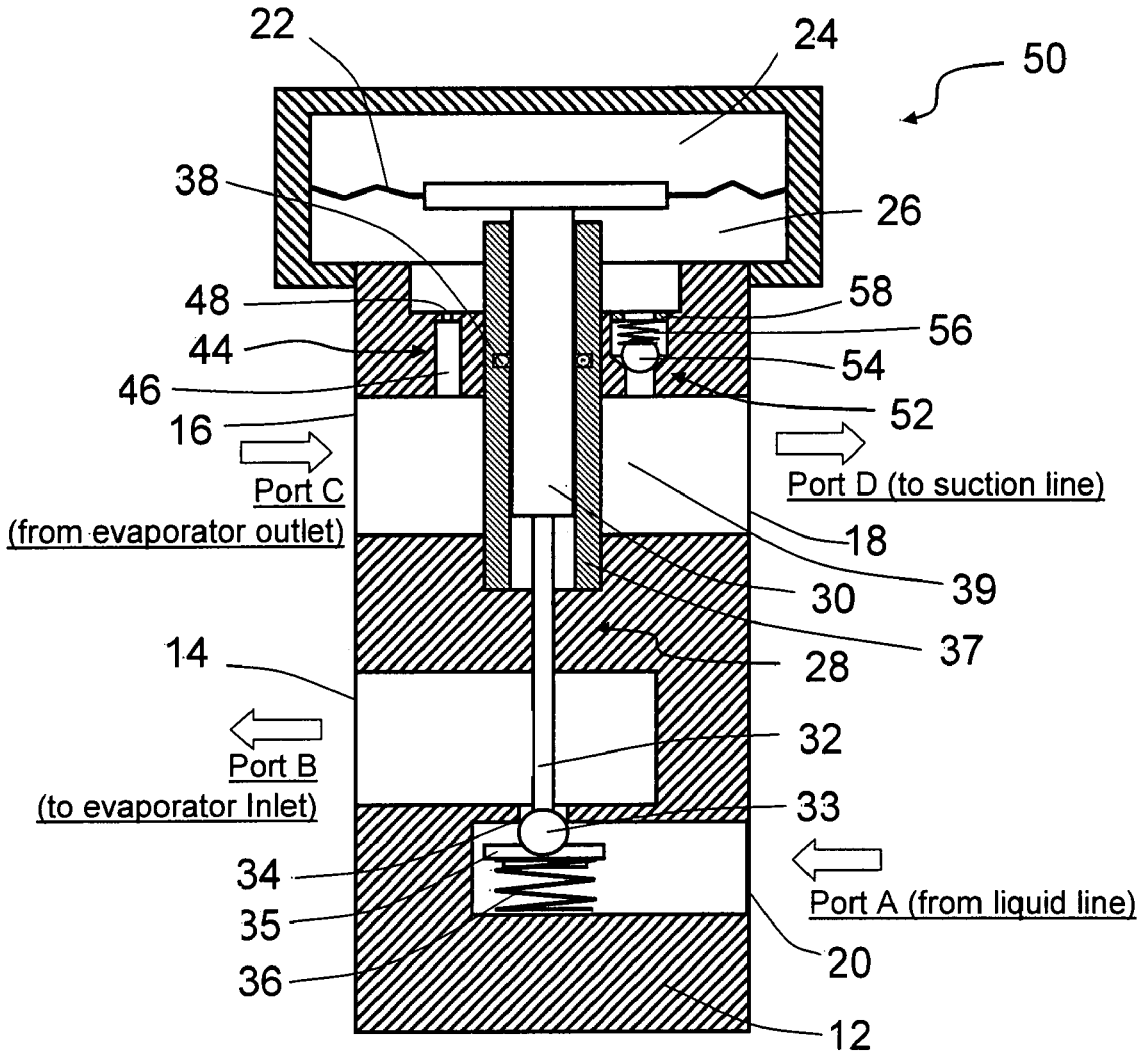
FIG. 5 illustrates a thermostatic expansion valve according to a second preferred embodiment of the present invention.

FIG. 5 illustrates a thermostatic expansion valve 50 according to a second preferred embodiment of the present invention. The flow passage 44 may be identical the flow passage shown in FIG. 2. The thermostatic expansion valve 50 further includes a check valve 52. The check valve 52 includes a ball 54 which only allows fluid flow from the sensor chamber 39 to the pressure chamber 26 when the pressure in the sensor chamber 39 is greater than the pressure in the pressure chamber 26 by a predetermined amount. This allows refrigerant to return to the pressure chamber 26 at a fluid flow rate greater than that of the flow passage 44 having the restricted orifice. Many air conditioning systems require a fast closure of the valve member 33 at the compressor turn-off. The check valve 52 may utilize a retention spring 56 to keep the ball seated in the closed position after the pressure differential between the pressure chamber 26 and the sensor chamber 39 has equalized. The retention spring 56 is retained by the ball 54 on a first end and a spring retainer 58 on a second end. Alternatively, the retention spring 56 may be eliminated when the position of the thermostatic expansion valve 50 will be oriented and maintained in a vertical direction such that the ball 54 remains seated after the pressure has equalized.

Figure 6:
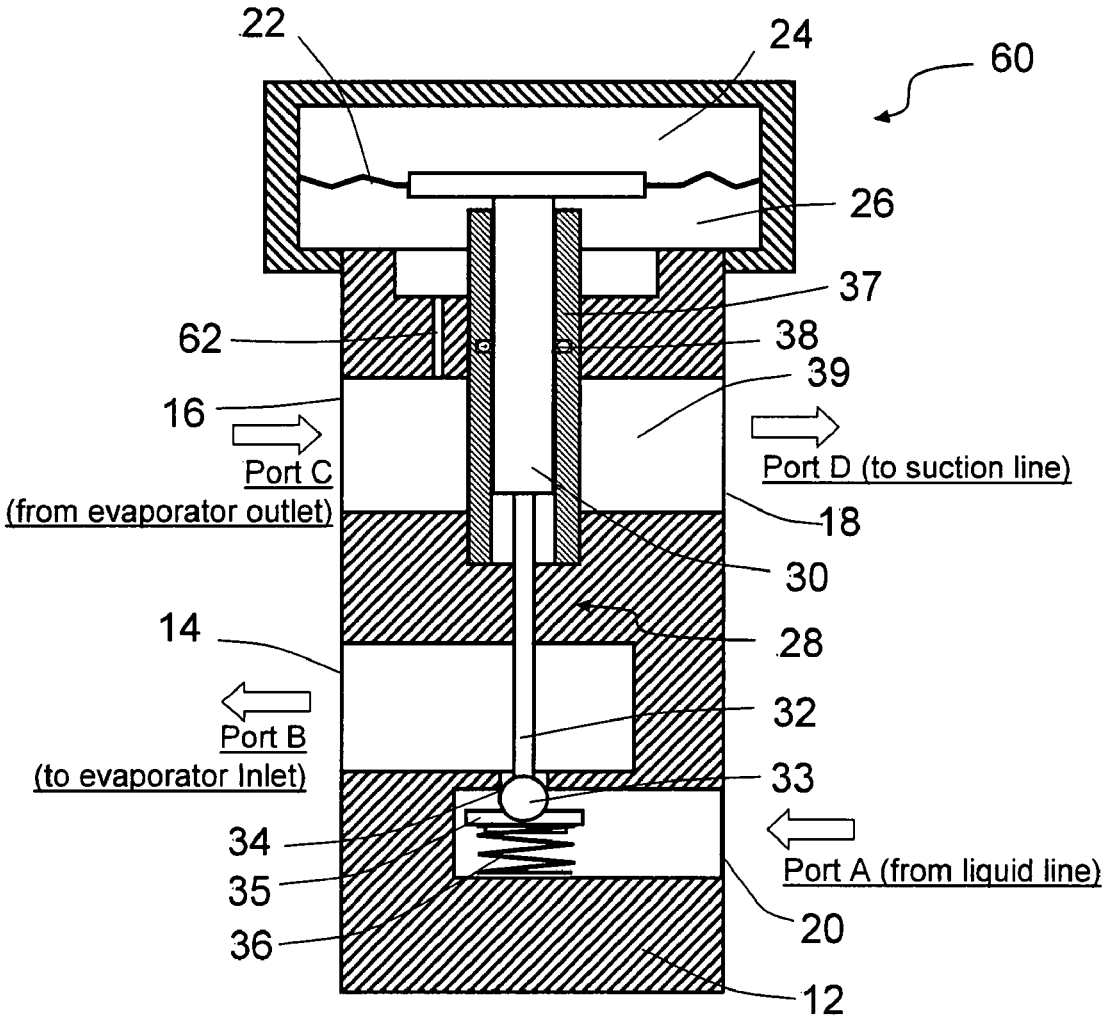
FIG. 6 illustrates a thermostatic expansion valve according to a third preferred embodiment of the present invention.

FIG. 6 illustrates a thermostatic expansion valve 60 according to a third preferred embodiment of the present invention. A flow passage 62 has a substantially uniform diameter or cross-section between the pressure chamber 26 and the sensor chamber 39; however, the flow passage 62 has a substantially smaller diameter (e.g., 0.5 mm or less) in comparison to the flow passage 40 shown in FIG. 1. This restricted flow path restricts the flow of fluid exiting the pressure chamber 26. As a result, this delays the initial opening of the valve member 33 and provides a gradual opening to its fully opened position similar to the embodiments of FIGS. 2 and 5. The delay allows more time for the high pressure side of the refrigerant loop to be pressurized thereby reaching a more sub-cooled state, absorbing residual vapor, and reducing the initial refrigerant flow rate, and as a result, the hissing noise is reduced. In an alternative embodiment, the length of the restriction flow passage 62 is substantially equal to or in the same order of magnitude as a width of a cross-section area of the restriction flow passage 62 (commonly referred to as a short orifice).

Figure 7:
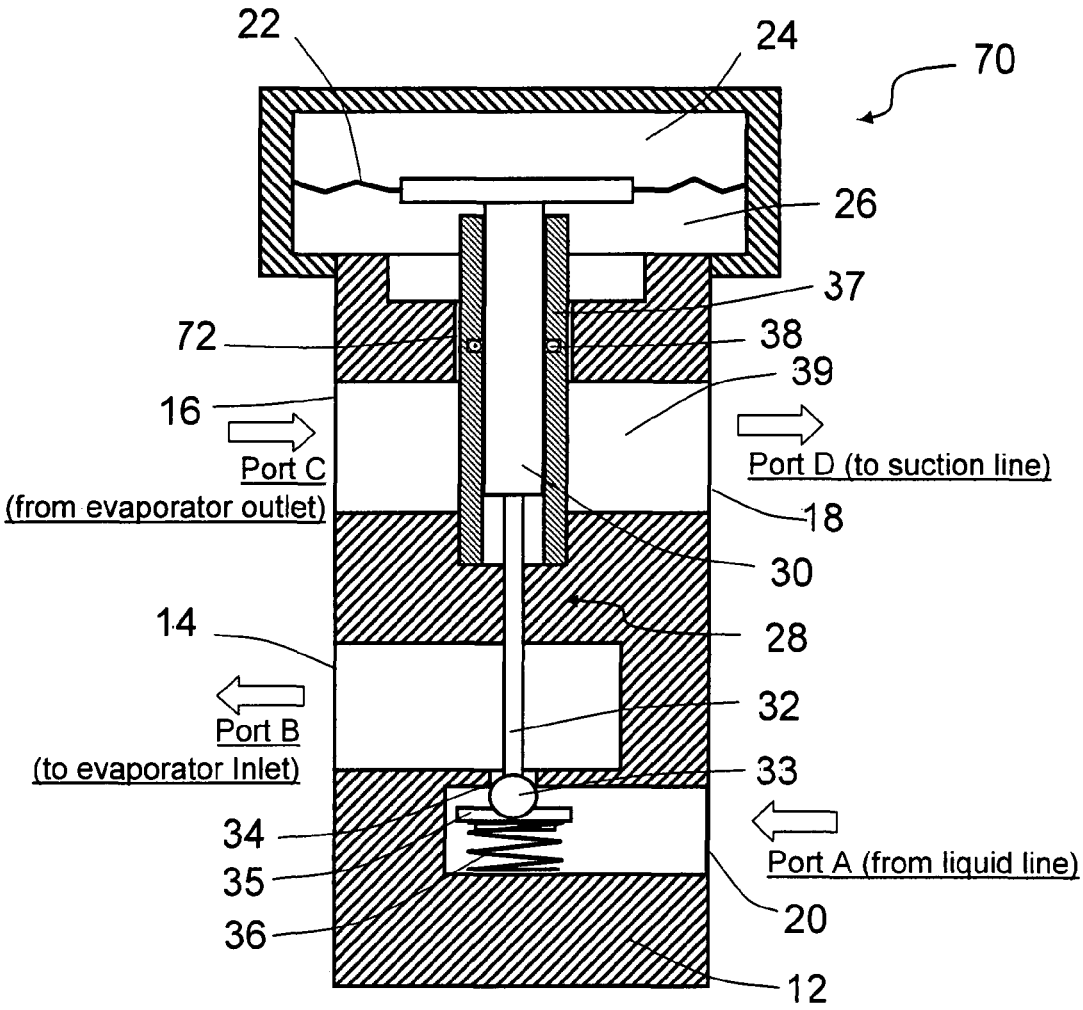
FIG. 7 illustrates a thermostatic expansion valve according to a fourth preferred embodiment of the present invention.

FIG. 7 illustrates a thermostatic expansion valve 70 according to a fourth preferred embodiment of the present invention. A flow passage 72 is disposed annularly around the sleeve 37. An interior cylindrical wall of the valve body 12 and a portion of the exterior cylindrical wall portion of the sleeve 37 define the passageway 72 therebetween. The flow passage 72 is sized so that the fluid flowing through this flow passage is substantially more restricted, in contrast to the flow passage in FIG. 1, for delaying and slowing the opening of the valve member 33, which reduces the hissing noise. Alternatively, the flow passage 72 may be replaced with at least one groove on the interior cylindrical wall of the valve body 12, or on at least a portion of the exterior cylindrical wall portion of the sleeve 37.

Figure 8:
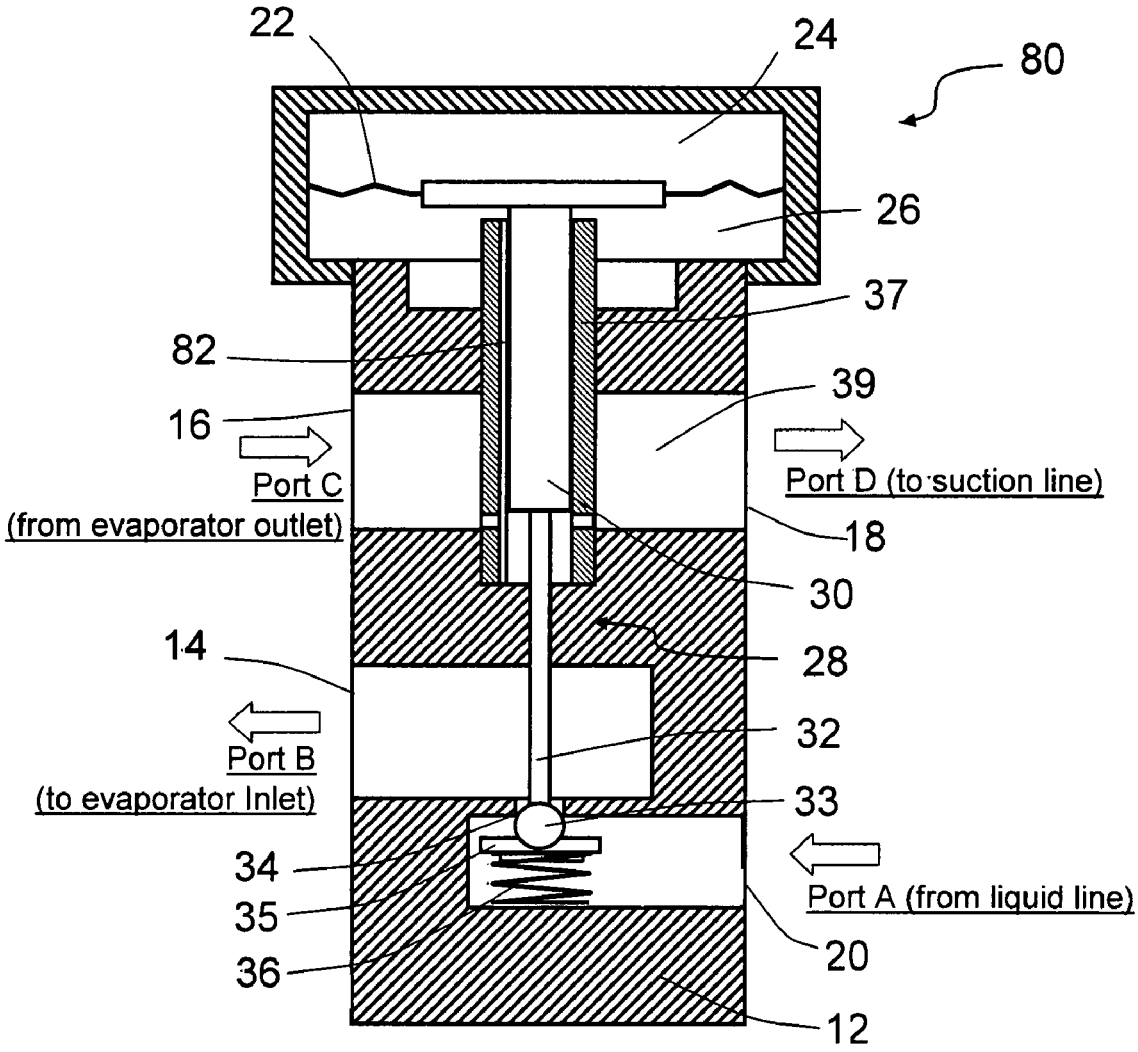
FIG. 8 illustrates a thermostatic expansion valve according to a fifth preferred embodiment of the present invention.

FIG. 8 illustrates a thermostatic expansion valve 80 according to a fifth preferred embodiment of the present invention. The flow passage 82 is disposed annularly around portion of a temperature sensor 30. A portion of the interior cylindrical wall of the sleeve 37 and a portion of an exterior cylindrical wall of the temperature sensor 30 define the passageway 82 therebetween. An example of sized radial clearance between the sleeve 37 and the exterior cylindrical wall of the temperature sensor 30 is 0.020 mm or less; however, depending upon the sizing of the thermostatic valve (i.e., size of respective flow channels, respective chambers, spring, diameter of temperature sensor and inner bore of the sleeve) the range may be different than that described above. Alternatively, the flow passage 82 may be replaced with at least one groove on a portion of the interior cylindrical wall of the sleeve 37, or on a portion of the exterior cylindrical wall of the temperature sensor. In addition, when a sleeve is not used, the flow passage may be created between the walls of the valve body 12 and the temperature sensor 30. In addition, each of the embodiments illustrated in FIGS. 6 through 8 may optionally include a check valve similar to the check valve 52 shown in FIG. 5 for a faster flow from the sensor chamber 39 to the pressure chamber 26, resulting in a faster closure of the valve member 33.

Figure 9:
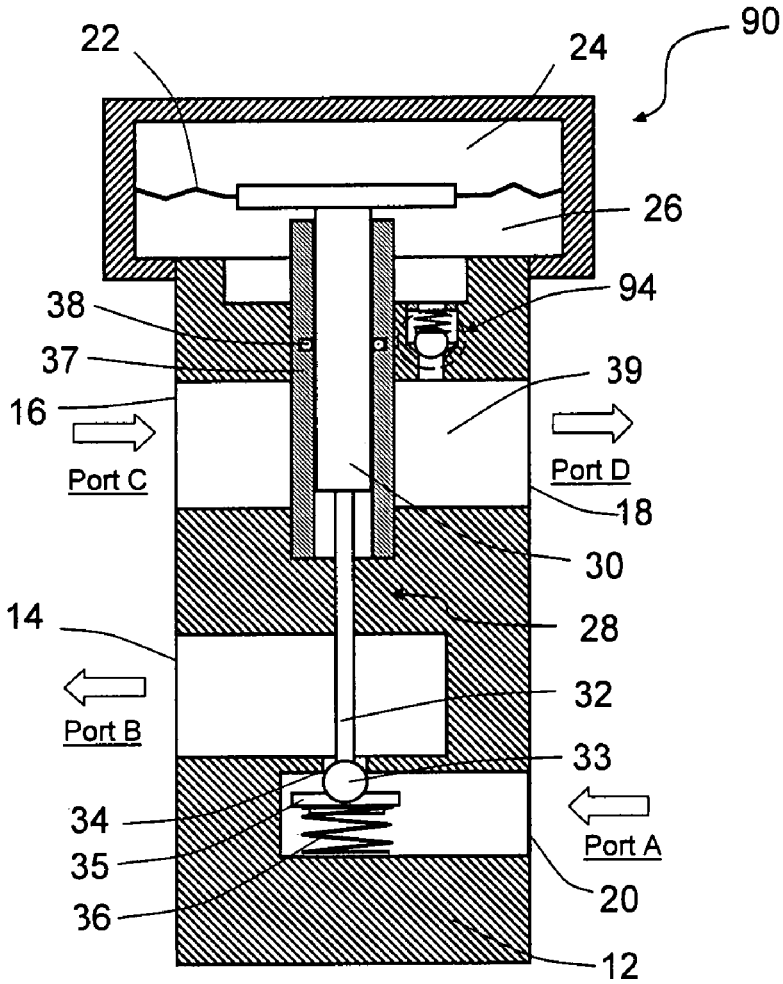
FIG. 9 illustrates a thermostatic expansion valve according to a sixth preferred embodiment of the present invention.
Figure 10:
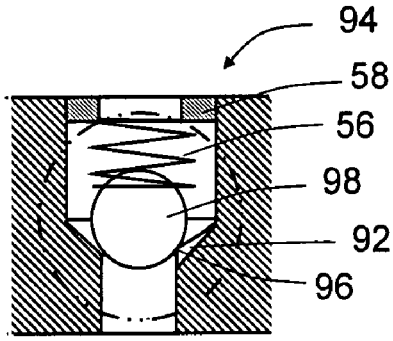
FIG. 10 illustrates an enlarged view of a portion of the thermostatic expansion valve of FIG. 9.

FIGS. 9 and 10 illustrate a thermostatic expansion valve 90 according to a sixth preferred embodiment of the present invention. A flow passage 92 is integrated within a check valve 94. The check valve 94 provides dual functionality such that it provides a substantial restriction of fluid flow from the pressure chamber 26, to the sensor chamber 39 in addition to a substantial open passage for returning fluid flow from the sensor chamber 39 to the pressure chamber 26. The check valve 94 is similar to the check valve shown in FIG. 5 with the addition of the flow passage 92.

FIG. 10 illustrates an enlarged view of the check valve 94. The flow passage 92 is created by a leakage path integrated into a seating area 96. The leakage path allows fluid to flow at a low flow rate around a ball 98 when it is seated. Preferably, the flow passage 92 includes a groove formed in the seating area 96 which allows fluid to flow around the ball 98 when seated on the seating area 96. Alternatively, the flow passage may be formed by an imperfection (i.e., out of round condition of the seating area, or the ball, or both). The imperfection prevents the ball 98 from completely closing the flow path around the seated ball 98.

Similar to the check valve as described in FIG. 5, check valve 94 functions in a same manner when relieving pressure from the sensor chamber 39 to pressure chamber 26. Fluid flows from the sensor chamber 39 to the pressure chamber 26 when the pressure differential between the sensor chamber 39 and the pressure chamber 26 is above a predetermined pressure threshold. As described earlier, the check valve 94 may be utilized without a retention spring 56 if the thermostatic expansion valve 90 is maintained in an upright position.

Figure 11:
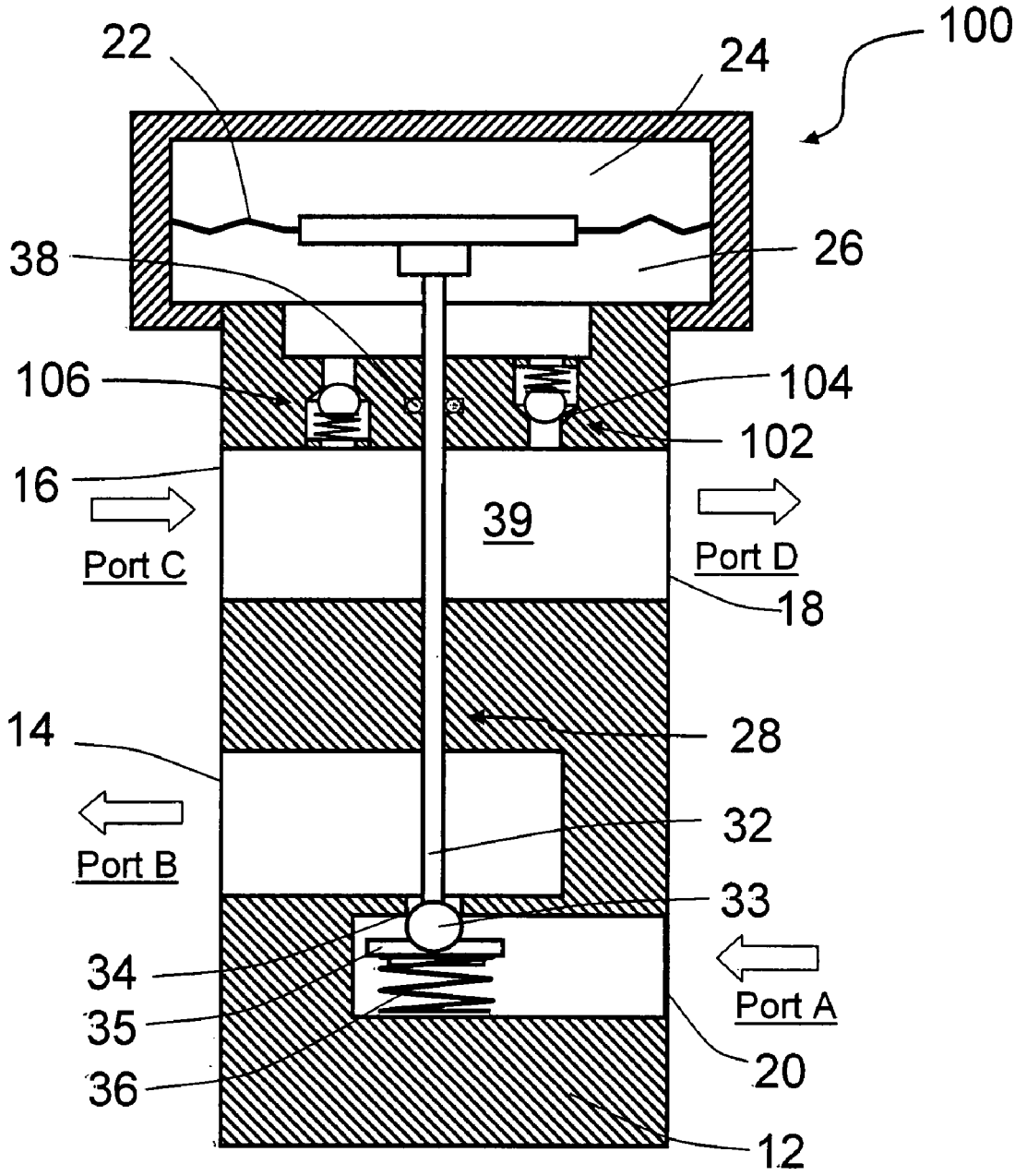
FIG. 11 illustrates a thermostatic expansion valve according to a seventh preferred embodiment of the present invention.

FIG. 11 illustrates thermostatic expansion valve 100 according to a seventh preferred embodiment of the present invention. A check valve 102 including a flow passage 104 is similar to the check valve and flow passage shown in FIGS. 9 and 10. The thermostatic expansion valve 100 further includes safety check valve 106 for allowing fluid flow from the pressure chamber 26 to the sensor chamber 39 in the event that there is insufficient fluid flow through the flow passage 104 of the check valve 102. The safety check valve 106 is a spring loaded check valve and is designed to open at a much higher opening pressure than other check valves previously discussed. The reasoning for the high opening pressure is to allow the operation of the fluid flow through the fluid passage 104 under normal operating conditions. Fluid flow through the safety check valve 106 will occur only when there is a malfunction of the fluid passage 104 such that an insufficient amount of fluid has been provided from the pressure chamber 26 to the sensor chamber 39.

The design features of the present inventions may be applied to thermostatic expansion valves of other designs, some of which for example may not have a temperature sensor 30. The top portion of the temperature sensor may include a hollow space open to the charge chamber 24 and filled with the charge fluid, and its exterior surface may be exposed to strong convection in the sensor chamber, especially if it is not covered with an optional sleeve. Alternatively, the thermostatic expansion valve may just have a rod that extends from the valve member to the diaphragm without the addition of a temperature sensor. In this example, the charge chamber is still able to sense the fluid temperature at the sensor chamber through other conduction and convention means.

It is well known that many thermostatic expansion valves do not include the sleeve 37, as illustrated in FIG. 11. In such designs, an O-ring (as shown in FIG. 11) or restrictive flow passage (similar to those in FIGS. 7 and 8) may be situated between the top portion of the temperature sensor (or the rod if no temperature sensor, as illustrated in FIG. 11 is used) and the surrounding portion of the valve body.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A thermostatic expansion valve for an air conditioning system, the valve comprising:

a valve body having an evaporator inlet port and an evaporator outlet port, the valve body further including a suction line port and a liquid line port;

a sensor chamber formed within the valve body and disposed between the evaporator outlet port and the suction line port;

a valve disposed within the valve body, the valve controlling a flow of refrigerant from the liquid line port to the evaporator inlet port;

a diaphragm separating a charge chamber and a pressure chamber where a pressure differential between a charge chamber and a pressure chamber controls the positioning of the valve;

a restriction flow passage located to provide fluid communication between the sensor chamber and the pressure chamber and configured to limit a flow rate from the pressure chamber to sensor chamber, thereby slowing the opening of the valve resulting in a reduction of noise generated following a startup of a compressor; and a check valve fluidically coupled between the sensor chamber and the pressure chamber for allowing fluid flow from the sensor chamber to the pressure chamber and blocking fluid flow from the pressure chamber to the sensor chamber.

2. The thermostatic expansion valve of claim 1 wherein the restriction flow passage includes a first passage section having a first cross-section area in fluid communication with a second passage section having a second cross-section area, the second cross-section area are being smaller than the first cross-section area and configured to restrict the flow of fluid from the pressure chamber to the sensor chamber.

3. The thermostatic expansion valve of claim 2 wherein a width of the second cross-section area is 0.2 mm or less.

4. The thermostatic expansion valve of claim 1 wherein the check valve includes a spring for biasing the check valve toward a closed position.

5. The thermostatic expansion valve of claim 1 wherein the check valve includes a check valve ball, and wherein the restriction flow passage is formed by a leakage flow path around the check valve ball when the check valve is in a seated position.

6. The thermostatic expansion valve of claim 5 wherein the leakage flow path includes a groove between the valve body and the check valve ball.

7. The thermostatic expansion valve of claim 5 wherein the wherein the leakage flow path includes a gap between the valve body and the check valve ball.

8. The thermostatic expansion valve of claim 1 wherein the restriction flow passage includes a uniform passage extending between the sensor chamber and the pressure chamber.

9. The thermostatic expansion valve of claim 8 wherein the restriction flow passage has a width of 0.5 mm or less.

10. The thermostatic expansion valve of claim 8 wherein the length of the restriction flow passage is of a same order of magnitude as a width of a cross-section area of the restriction flow passage.

11. The thermostatic expansion valve of claim 1 further comprising a rod coupled to the valve, an opposing end of the rod coupled to a temperature sensor, an opposing end of the temperature sensor coupled to the diagram, wherein the thermostatic expansion valve further comprises a cylindrical sleeve extending around the temperature sensor, wherein the restriction flow passage is disposed between the valve body and the sleeve.

12. The thermostatic expansion valve of claim 11 wherein the radial clearance between the valve body and the sleeve is 0.020 mm or less.

13. The thermostatic expansion valve of claim 1 further comprising a rod coupled to the valve, an opposing end of the rod coupled to a temperature sensor, an opposing end of the temperature sensor coupled to the diaphragm, wherein the thermostatic expansion valve further comprises a cylindrical sleeve extending around the temperature sensor, wherein the restriction flow passage extending between the sensor chamber and the pressure chamber is located between the temperature sensor and the sleeve.

14. The thermostatic expansion valve of claim 13 wherein the radial clearance between the temperature sensor and the sleeve is 0.020 mm or less.

15. The thermostatic expansion valve of claim 1 further comprising a safety check valve disposed between the pressure chamber and the sensor chamber, the safety check valve configured to allow fluid flow from the pressure chamber to the sensor chamber when a pressure in the pressure chamber is at least a predetermined amount above a pressure in the sensor chamber.

16. The thermostatic expansion valve of claim 15 wherein the safety check valve is spring loaded.

17. A thermostatic expansion valve for an air conditioning system, the valve comprising:

a valve body having an evaporator inlet port and an evaporator outlet port, the valve body further including a suction line port and a liquid line port;

a sensor chamber formed within the valve body and disposed between the evaporator outlet port and the suction line port;

a valve disposed within the valve body, the valve controlling a flow of refrigerant from the liquid line port to the evaporator inlet port;

a diaphragm separating a charge chamber and a pressure chamber where a pressure differential between a charge chamber and a pressure chamber operatively controls the positioning of the valve;

a restriction flow passage located to provide fluid communication between the sensor chamber and the pressure chamber and configured to limit a flow rate from the pressure chamber to sensor chamber, thereby slowing the opening of the valve resulting in a reduction of noise generated following a startup of a compressor; and a check valve fluidically coupled between the sensor chamber and the pressure chamber for allowing fluid flow from the sensor chamber to the pressure chamber and blocking fluid flow from the pressure chamber to the sensor chamber.

18. A thermostatic expansion valve for an air conditioning system, the valve comprising:

a valve body having an evaporator inlet port and an evaporator outlet port, the valve body further including a suction line port and a liquid line port;

a sensor chamber formed within the valve body and disposed between the evaporator outlet port and the suction line port;

a valve disposed within the valve body, the valve controlling a flow of refrigerant from the liquid line port to the evaporator inlet port;

a diaphragm separating a charge chamber and a pressure chamber where a pressure differential between a charge chamber and a pressure chamber controls the positioning of the valve;

a check valve that includes a check valve ball disposed between the sensor chamber and the pressure chamber for allowing fluid flow from the sensor chamber to the pressure chamber when the pressure difference between the sensor chamber and pressure chamber is above a predetermined pressure differential; and a restriction flow passage located to provide fluid communication between the sensor chamber and the pressure chamber and configured to limit a flow rate between the pressure chamber and the sensor chamber, thereby slowing the opening of the valve resulting in a reduction of noise generated following a startup of a compressor, wherein the restriction flow passage is formed by a leakage flow path around the check valve ball when the check valve ball is in a seated position.

* * * * *